US008863537B2

(12) United States Patent
Junge

(10) Patent No.: US 8,863,537 B2
(45) Date of Patent: Oct. 21, 2014

(54) SINGLE EVAPORATOR REFRIGERATION SYSTEM FOR MULTI-COMPARTMENT REFRIGERATOR APPLIANCE WITH ISOLATED AIR FLOWS

(75) Inventor: Brent A. Junge, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 1653 days.

(21) Appl. No.: 11/457,157

(22) Filed: Jul. 13, 2006

(65) Prior Publication Data

US 2008/0011013 A1 Jan. 17, 2008

(51) Int. Cl.

| | |
|---|---|
| ***F25D 17/00*** | (2006.01) |
| ***F25D 17/04*** | (2006.01) |
| ***F25D 11/02*** | (2006.01) |
| ***F25D 17/08*** | (2006.01) |

(52) U.S. Cl.

CPC ..... *F25D 11/02* (2013.01); *F25D 2317/0682* (2013.01); *F25D 2700/12* (2013.01); *F25D 2700/122* (2013.01); *F25D 2400/06* (2013.01); *F25D 17/08* (2013.01)

USPC ..... 62/179; 62/408; 62/441; 62/443

(58) Field of Classification Search

USPC ..... 62/179, 441, 443, 408

See application file for complete search history.

(56) References Cited

U.S. PATENT DOCUMENTS

| | | | | | |
|---|---|---|---|---|---|
| 2,801,526 | A | * | 8/1957 | Solley, Jr. | 62/186 |
| 2,982,115 | A | * | 5/1961 | Wurtz et al. | 62/419 |
| 3,005,321 | A | * | 10/1961 | Devery | 62/186 |
| 3,359,751 | A | * | 12/1967 | Stevens | 62/186 |
| 4,619,114 | A | * | 10/1986 | Wilson | 62/180 |
| 4,708,197 | A | | 11/1987 | Robbins | |
| 4,722,200 | A | * | 2/1988 | Frohbieter | 62/382 |
| 5,178,124 | A | | 1/1993 | Lu et al. | |
| 5,375,428 | A | | 12/1994 | LeClear et al. | |
| 5,465,591 | A | | 11/1995 | Cur et al. | |
| 5,490,395 | A | | 2/1996 | Williams et al. | |
| 5,588,484 | A | * | 12/1996 | Baker et al. | 165/122 |
| 5,899,083 | A | * | 5/1999 | Peterson et al. | 62/186 |
| 6,364,007 | B1 | | 4/2002 | Fischer | |

* cited by examiner

*Primary Examiner* — Allana Lewin
*Assistant Examiner* — Travis Ruby

(57) ABSTRACT

A refrigeration appliance has a cabinet having a first compartment, a second separate compartment and a refrigeration system including a compressor, an evaporator and a condenser. The evaporator is associated with the first compartment to lower a temperature of the first compartment air. A heat exchanger is exposed to the temperature of the first compartment and has a surface area exposed to second compartment air. An air moving device is associated with the second compartment to direct a flow of second compartment air over the heat exchanger surface area and circulate the second compartment air within the second compartment. The cabinet, compartments and heat exchanger are configured such that first compartment air is completely isolated from second compartment air.

8 Claims, 2 Drawing Sheets

SINGLE EVAPORATOR REFRIGERATION SYSTEM FOR MULTI-COMPARTMENT REFRIGERATOR APPLIANCE WITH ISOLATED AIR FLOWS

BACKGROUND OF THE INVENTION

This invention relates generally to combined refrigerator/freezer appliances.

Combined refrigerator/freezer appliances typically have two or more compartments that are refrigerated to differing temperatures, one being chilled to a temperature well below the freezing temperature of water, such as around 0° F. and the other being chilled to a below ambient temperature, which is above freezing, such as around 40° F. To chill the two different compartments to these temperatures, a refrigeration system is typically employed which includes one or two evaporator components.

In a single evaporator system, such as that disclosed in U.S. Pat. No. 5,490,395, the evaporator is located in, or in close communication with the freezer compartment, and the evaporator is chilled to below the desired temperature for the freezer compartment. Air is circulated over the evaporator to chill the freezer compartment. To cool the refrigerator or fresh food compartment, air is ducted out of the freezer compartment and is circulated through the fresh food compartment, and then returned to the freezer compartment. A separate fan is usually provided for the fresh food compartment air circulation system along with baffles for permitting or preventing the flow of sub-freezing air into the fresh food compartment. Problems that result from single evaporator systems are that the significantly higher humidity levels in the fresh food compartment are transferred to the freezer compartment as the air is circulated between the two compartments, reducing the desired humidity level in the fresh food compartment and increasing a build-up of frost in the freezer compartment, and food odors are also transmitted between the two compartments.

In a dual or multi-evaporator refrigerator/freezer appliance, such as disclosed in U.S. Pat. No. 5,465,591, a separate evaporator is used for each compartment, which addresses some of the problems listed above since the air in each compartment is isolated from the air in other compartments, however, there are significant increased costs for two separate evaporators and possibly two complete refrigeration systems. Also, there are more joints in the cooling system that may fail over time, and the addition of another evaporator and refrigerant system for that evaporator, results in a loss of at least 0.3 to 0.5 cubic feet from the food storage space in the compartments. Also, proving two evaporators results in increased tooling costs and factory complexity.

A single evaporator system is disclosed in U.S. Pat. No. 5,375,428 in which the single evaporator is positioned in the mullion between the freezer compartment and the fresh food compartment. Air is alternately circulated over the evaporator from one of the two compartments, such that the mixing of air between the two compartments is reduced, although not eliminated. This system requires that the evaporator be operated at different pressures, and hence different temperatures, depending on which of the two compartments is being cooled, thereby increasing the complexity of the system and control. Also, in such a system, only one compartment may be cooled at a time, even when both compartments may be demanding cooling.

SUMMARY OF THE INVENTION

The present invention addresses the problems associated with the prior art and provides a refrigeration appliance with a cabinet having a first compartment, a second separate compartment and a refrigeration system including a compressor, an evaporator and a condenser. The evaporator is associated with the first compartment to lower a temperature of the first compartment air. A heat exchanger is exposed to the temperature of the first compartment and has a surface area exposed to second compartment air. An air moving device is associated with the second compartment to direct a flow of second compartment air over the heat exchanger surface area and circulate the second compartment air within the second compartment. The cabinet, compartments and heat exchanger are configured such that first compartment air is completely isolated from second compartment air.

In an embodiment, the heat exchanger includes a plate in direct contact with the evaporator.

In an embodiment, the heat exchanger comprises an air passage for the first compartment air and a separate air passage for the second compartment air.

In an embodiment, the heat exchanger comprises an air passage for only second compartment air.

In an embodiment, the heat exchanger comprises a plate having one side in thermal contact with the first compartment, the plate being thermally shielded from the second compartment.

In an embodiment, a first temperature sensor is provided in the first compartment in communication with a control to operate the first air moving device and the refrigeration system, a second temperature sensor is provided in the second compartment in communication with the control to operate the second air moving device, and operation of the first air moving device is independent from operation of the second air moving device.

In an embodiment, the heat exchanger is located at a wall separating the first compartment from the second compartment.

In an embodiment, the invention provides a refrigeration appliance including a cabinet having a first compartment, a second separate compartment, and a refrigeration system including a compressor, an evaporator and a condenser. A first fan is in air flow communication with the first compartment to direct a flow of first compartment air over the evaporator and circulate the first compartment air within the first compartment to lower a temperature within the first compartment. A heat exchanger is provided having a metal plate with a first surface area in thermal communication with the first compartment and having a second surface area exposed to second compartment air. A second fan is in air flow communication with the second compartment to direct a flow of second compartment air over the heat exchanger second surface area and circulate the second compartment air within the second compartment. The cabinet, compartments and heat exchanger are configured such that no surface area or space is exposed to both first compartment air and second compartment air.

In an embodiment, the invention provides a refrigeration appliance including a cabinet having a first compartment, a second separate compartment, and a refrigeration system including a compressor, an evaporator and a condenser. A first fan is located in the first compartment to direct a flow of first compartment air over the evaporator and circulate the first compartment air within the first compartment to lower a temperature within the first compartment. A heat exchanger is located in a wall separating the first compartment and the second compartment having a metal plate with a first surface area in thermal communication with the first compartment and having a second surface area exposed to second compartment air. A second fan is located in the second compartment to direct a flow of second compartment air over the heat exchanger second surface area and circulate the second compartment air within the second compartment. The cabinet, compartments and heat exchanger are configured such that no surface area or space is exposed to both first compartment air and second compartment air.

DETAILED DESCRIPTION OF THE PREFERRED EMBODIMENTS

Figure 1:
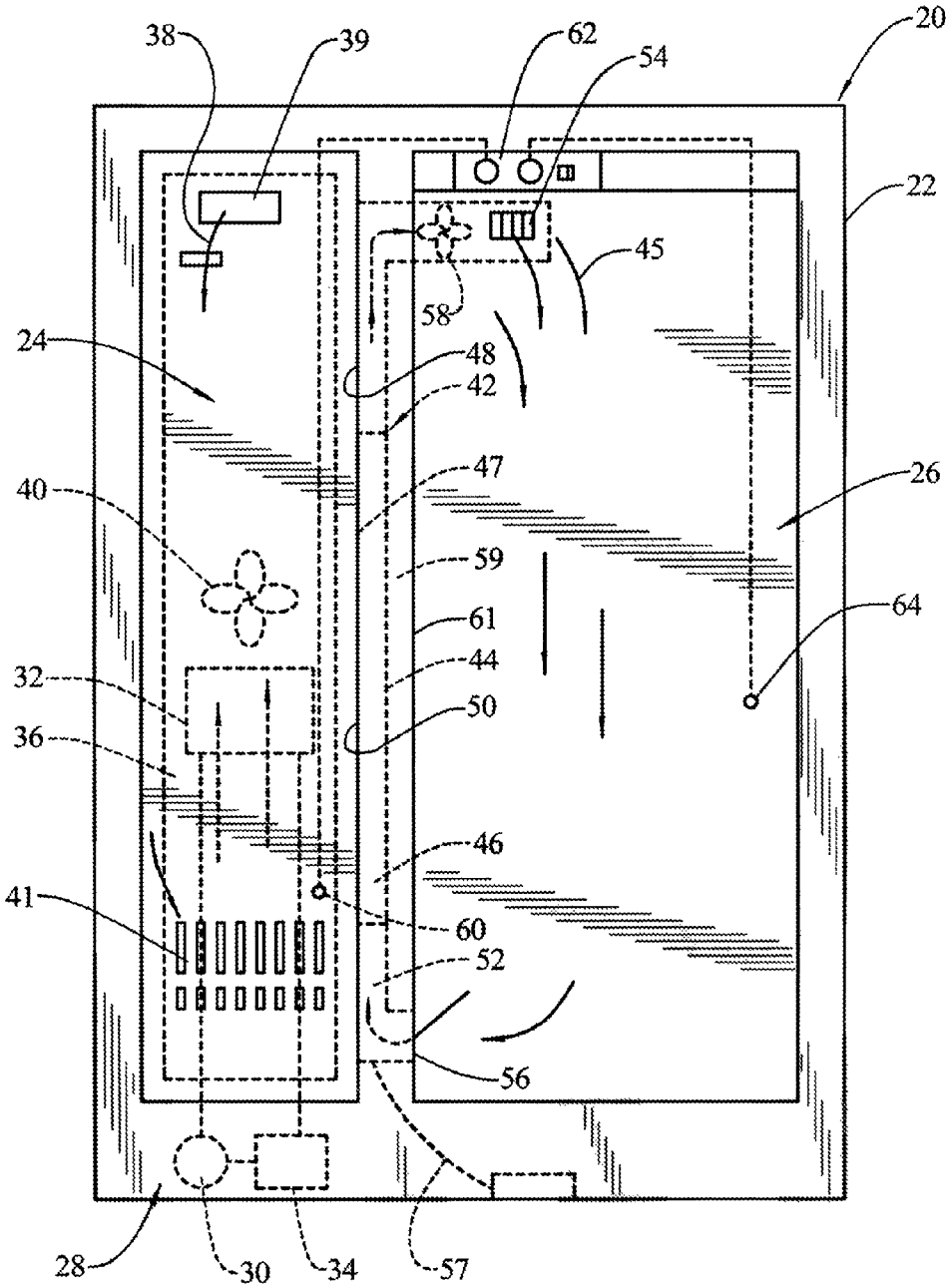
FIG. 1 is a front elevational view of a refrigeration appliance incorporating the present invention, with the doors removed for clarity.

The present invention provides a refrigeration appliance 20 with a cabinet 22 having a first compartment 24, a second separate compartment 26 and a refrigeration system 28. The refrigeration appliance 20 in which the invention finds particular utility is a side-by-side refrigerator-freezer, in which the first compartment 24 is a freezer compartment and the second compartment 26 is a fresh food compartment. The invention may also be used in other appliances, such as where the freezer compartment is located above or below the fresh food compartment. Also, although the preferred refrigeration appliance 20 includes a compartment maintained at a temperature below freezing and a compartment above freezing, the invention could also be utilized in an appliance where both compartments are maintained below freezing or both compartments are maintained above freezing.

The refrigeration system 28 may be of conventional design and include a compressor 30, an evaporator 32 and a condenser 34. The evaporator 32 is associated with the first compartment 24 to lower a temperature of first compartment air 38. For example, the evaporator 32 may be located in a passage 36 through which a flow of first compartment air 38 is directed by means of an air moving device 40, such as a fan. The first compartment air 38 is introduced into the first compartment 24 via an inlet 39 from the passage 36 and flows back to the evaporator 32 via a return 41. In other embodiments, the evaporator 32 may have a component that is merely exposed to the interior of the first compartment 24 and a general air flow created by an air moving device within the first compartment will effect a heat transfer at the evaporator. In other embodiments, natural convection currents may move the air in the first compartment 24 and over the evaporator 32, without the need for a separate air moving device associated with the first compartment.

A heat exchanger 42 is exposed to the temperature of the first compartment 24 and has a surface area 44 exposed to second compartment air 45. As illustrated in the embodiment shown in FIG. 1, the heat exchanger 42 may include a metal plate 46 that lies against an inside surface 47 of a center mullion wall 48. In this embodiment, the plate has one side 50 in thermal contact with the first compartment 24. The heat exchanger 42 may include an air passage 52 located in the center mullion wall 48 which communicates with the second compartment 26, such as by an inlet vent 54 and a return vent 56. In this embodiment, the heat exchanger 42 includes an air passage 52 for only second compartment air 45. Other embodiments discussed below provide air passages for both first 38 and second 45 compartment air. The heat exchanger 42 may also be provided with a condensation drain 57 to permit any collected condensation from the heat exchanger to be removed. The condensation drain 57 may lead to a common collection or storage area with condensation drained from the evaporator 32, or a separate storage area may be provided.

An air moving device 58 is associated with the second compartment 26 to direct a flow of second compartment air 45 over the heat exchanger surface area 44 and circulate the second compartment air within the second compartment by drawing the second compartment air in through the return vent 56 and dispensing the second compartment air into the second compartment through the inlet vent 54. For example, the air moving device 58 may be a fan that operates at a single speed, or it may be a variable speed fan.

The cabinet 22, compartments 24, 26 and heat exchanger 42 are configured such that first compartment air 38 is completely isolated from second compartment air 45. That is, the air flow passage 52 for the second compartment air 45 does not come into contact with any surface contacted by the first compartment air 38, and there is no passage or area through which both first compartment air and second compartment air flow, even at different times.

The plate 46 may be a flat plate, or it may be provided with ribs or fins, preferably oriented in a direction of air flow along the plate, to increase the effective surface area contacted by the second compartment air 45.

The plate 46 may be thermally shielded from the second compartment 26, such as by a layer of insulation material 59, or by being positioned away from the second compartment. For example, the air passage 52 may be formed by an expanded polystyrene material which both forms that passage and provides heat insulation between the plate 46 and the second compartment 26. By providing the insulation, a second compartment side 61 of the mullion wall 48 will remain at close to the temperature of the second compartment 26, rather than the temperature of the plate 46, thereby reducing the possibility of formation of condensation on the mullion wall. Also, by providing the insulation 59, cooling of the second compartment 26 by the heat exchanger 42 will occur only when second compartment air 45 is being moved over the plate 46.

A first temperature sensor 60 may be provided in the first compartment 24 in communication with a control 62 to operate the first air moving device 40 and the refrigeration system 28. A second temperature sensor 64 may be provided in the second compartment 26 in communication with the control 62 to operate the second air moving device 58. Operation of the first air moving device 40 may be independent from operation of the second air moving device 58, such that both air moving devices may be operating simultaneously, or one or both may be turned off at any given time, depending on the temperature sensed by the temperature sensors 60, 64 located in each compartment 24, 26.

The second air moving device 58 may be operated at different speeds, depending on the temperature sensed by the second temperature sensor 64, or the differential between the sensed temperature and a desired temperature entered in the control 62 by a user. Applicant has found that a higher volume flow rate of air, such as on the order of 20 to 25 cfm, may be provided in the second compartment 26, such as a fresh food compartment, than was practical in prior refrigerator appliances which typically has volume flow rates of 5 to 8 cfm. This higher volume air flow rate results since the temperature of the heat exchanger 42 contacted by the second compartment air 45 is not as low as the temperature in the first compartment 24, and the transfer of heat is less rapid when utilizing the heat exchanger as opposed to circulating air from the first compartment 24 through the second compartment 26. The higher volume flow rate is advantageous in that it helps to prevent condensation from occurring on surfaces in the second compartment 26, and helps in removing any condensation that does occur in the second compartment. That condensation is transferred to the heat exchanger and is removed through the condensation drain 57 as described above.

Figure 2:
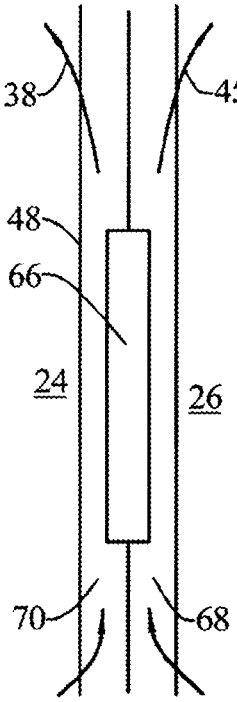
FIG. 2 is a partial front sectional view of the plenum wall in a refrigeration appliance with a second embodiment of the invention.

In an embodiment, as illustrated in FIG. 2, the heat exchanger 42 may comprise a plate 66 that is exposed to direct air flow from both the second compartment 26, as well as the first compartment 24, although on different sides of the plate. An air flow passage 68 may be provided for the second compartment air 45, as well as an air flow passage 70 for the first compartment air 38. The two air flow passages 68, 70 remain isolated from one another so that there will be no mixing of first compartment air 38 and second compartment air 45.

Figure 3:
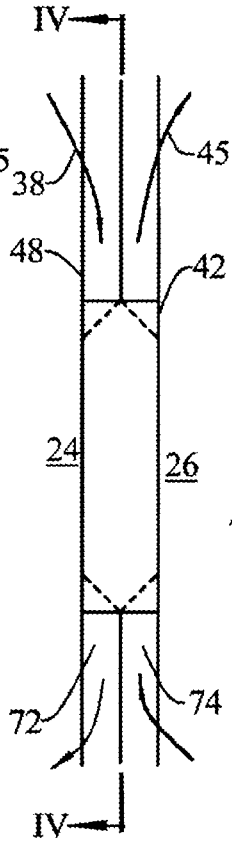
FIG. 3 is a partial front sectional view of the plenum wall in a refrigeration appliance with a third embodiment of the invention.
Figure 4:
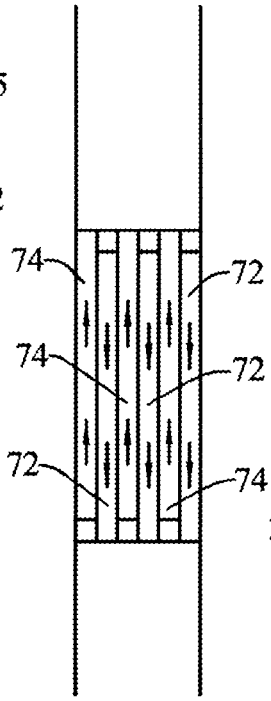
FIG. 4 is a side sectional view of the plenum wall taken generally along the line IV-IV of FIG. 3

In an embodiment, as illustrated in FIGS. 3 and 4, again separate air flow passages 72, 74 may be provided for the second compartment air 45 and the first compartment air 38. This heat exchanger 42 may be constructed as a conventional air to air heat exchanger, in which the heat from the second compartment air 45 is transferred to and absorbed by the first compartment air 38, without any mixing of the two air flows. This heat exchanger may be constructed in the form of side by side parallel channels, tubes, or other known arrangements for air to air heat exchangers.

Figure 5:
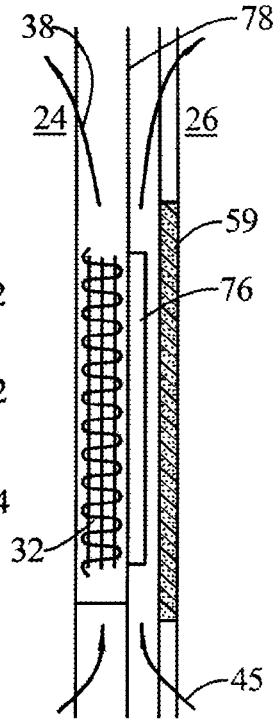
FIG. 5 is a partial front sectional view of the plenum wall in a refrigeration appliance with a fourth embodiment of the invention.

In an embodiment, as illustrated in FIG. 5, the heat exchanger 42 includes a plate 76 in direct contact with the evaporator 32. The evaporator 32 may be positioned in abutting relationship with a wall 78 separating the first 24 and second 26 compartments, which provides several benefits. For example, the efficiency of the heat transfer from the plate 76 is increased, since the transfer occurs by conduction directly to the evaporator, in addition to convection and radiation. During a defrosting operation of the evaporator 32, when the temperature of the evaporator is elevated to remove frost from the evaporator, the plate 76 would also be heated, thereby removing any frost build-up on the plate.

The present invention, by maintaining an isolation between the first compartment air 38 and the second compartment air 45, allows a higher level of humidity to be maintained in the second compartment 26, when it is a fresh food compartment, than in the first compartment 24 when it is a freezer compartment, which allows for a greater refrigerated lifespan for fresh foods. This also allows for a low level of humidity to be maintained in the first compartment 24, which, when operated as a freezer compartment, will reduce the build-up of frost in the first compartment and on the evaporator 32, allowing for a higher operating efficiency, and allowing for other materials, such as glass shelves, to be used in the first compartment. Condensation in the second compartment, when a fresh food compartment is reduced by allowing a greater and nearly continuous flow of air via the second air moving device 58, if need be, since any collected condensation in the second compartment will be evaporated and transported by the moving second compartment air 45, and the moisture will be recondensed at the cooler surface of the heat exchanger 42

The transfer of odors from one compartment to the other is greatly reduced or eliminated by having the first compartment air 38 and the second compartment air 45 isolated from each other and by not having any areas or surfaces contacted by both first compartment air and second compartment air, even if not simultaneously.

The present invention has been described utilizing particular embodiments. As will be evident to those skilled in the art, changes and modifications may be made to the disclosed embodiments and yet fall within the scope of the present invention. For example, various components could be utilized separately or independently in some embodiments without using all of the other components in the particular described embodiment. The disclosed embodiment is provided only to illustrate aspects of the present invention and not in any way to limit the scope and coverage of the invention. The scope of the invention is therefore to be limited only by the appended claims.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A refrigeration appliance comprising:

a cabinet having a first compartment and a second separate compartment, a refrigeration system including a compressor, an evaporator and a condenser, the evaporator being associated with the first compartment to lower a temperature of the first compartment air, a heat exchanger being exposed to the temperature of the first compartment and having a surface area in the form of a flat plate with a plurality of ribs exposed to second compartment air, an air moving device associated with the second compartment to direct a flow of second compartment air over the heat exchanger surface area and circulate the second compartment air within the second compartment, the air moving device arranged to operate at a speed to produce a volume flow rate of air greater than 8 cfm and not greater than about 25 cfm in the second compartment, the ribs on the plate being oriented in a direction of air flow of the second compartment air over the plate, the cabinet, compartments and heat exchanger being configured such that first compartment air is completely isolated from second compartment air.

2. The refrigeration appliance of claim 1, wherein the heat exchanger comprises an air passage for only second compartment air and comprises no air passages for first compartment air.

3. The refrigeration appliance of claim 1, including a first air moving device in the first compartment, a first temperature sensor in the first compartment in communication with a control to operate the first air moving device and the refrigeration system, a second temperature sensor in the second compartment in communication with the control to operate the air moving device in the second compartment, and wherein operation of the first air moving device is independent from operation of the second compartment air moving device.

4. The refrigeration appliance of claim 1, wherein the heat exchanger is located at a wall separating the first compartment from the second compartment.

5. A refrigeration appliance comprising:

a cabinet having a first compartment and a second separate compartment, a refrigeration system including a compressor, an evaporator and a condenser, a first fan in air flow communication with the first compartment to direct a flow of first compartment air over the evaporator and circulate the first compartment air within the first compartment to lower a temperature within the first compartment, a heat exchanger having a metal plate with a first surface area in thermal communication with the first compartment and having a second surface area exposed to second compartment air, a second fan in air flow communication with the second compartment to direct a flow of second compartment air over the heat exchanger second surface area and circulate the second compartment air within the second compartment, the second fan arranged to operate at a speed to produce a volume flow rate of air in the range of 20 to 25 cfm in the second compartment, the second surface area being provided with a plurality of ribs oriented in a direction of air flow of the second compartment air over the plate, the cabinet, compartments and heat exchanger being configured such that no surface area or space is exposed to both first compartment air and second compartment air.

6. The refrigeration appliance of claim 5, wherein the heat exchanger comprises an air passage for only second compartment air and comprises no air passages for first compartment air.

7. The refrigeration appliance of claim 5, including a first temperature sensor in the first compartment in communication with a control to operate the first fan and the refrigeration system, a second temperature sensor in the second compartment in communication with the control to operate the second fan, and wherein operation of the first fan device is independent from operation of the second fan.

8. The refrigeration appliance of claim 5, wherein the heat exchanger is located at a wall separating the first compartment from the second compartment.

* * * * *